United States Patent [19]

Oka et al.

[11] Patent Number: 4,729,567

[45] Date of Patent: Mar. 8, 1988

[54] GOLF BALL

[75] Inventors: Kengo Oka, Nishinomiya; Kaname Yamada, Kakogawa, both of Japan

[73] Assignee: Sumitomo Rubber Industries, Ltd., Hyogo, Japan

[21] Appl. No.: 841,832

[22] Filed: Mar. 20, 1986

[30] Foreign Application Priority Data

Sep. 30, 1985 [JP] Japan ..... 60-218759

[51] Int. Cl.[4] ..... A63B 37/12

[52] U.S. Cl. ..... 273/232

[58] Field of Search ..... 273/232, 235 R

[56] References Cited

U.S. PATENT DOCUMENTS 4,090,716 5/1978 Martin et al. ..... 273/232
4,560,168 12/1985 Aoyama ..... 273/232

FOREIGN PATENT DOCUMENTS 17244 6/1979 Australia ..... 273/232
967187 5/1975 Canada ..... 273/232
107170 12/1955 Japan .
96272 11/1958 Japan .
115330 10/1978 Japan .
377354 7/1932 United Kingdom ..... 273/232
2103939 2/1983 United Kingdom ..... 273/232
2148132 5/1985 United Kingdom ..... 273/232

*Primary Examiner*—George J. Marlo
*Attorney, Agent, or Firm*—Birch, Stewart, Kolasch & Birch

[57] ABSTRACT

A golf ball provided with two to four different sizes of dimples in the form of a 20–12 hedron and having different diameters from each other which vary in a ratio of 1.25–1.50, with the dimples being equally spaced over the entire surface of the golf ball, such that the flow of the air at every cross section crossing at right angles to the rotational axis of the golf ball is made equal, and at the same time, the angular difference between separation points of the dimples is minimized.

8 Claims, 12 Drawing Figures

GOLF BALL

BACKGROUND OF THE INVENTION

1. Field of the Invention

The present invention generally relates to golf balls and, more particularly to golf balls having an improved arrangement of dimples thereon.

2. Description of the Prior Art

Heretofore, a lot of improvements or reforms have been proposed, and some of which have been actually put into practice, with respect to the pattern and the dimension of dimples formed on the surface of golf balls, mainly for the purpose of improving flight characteristics of the golf balls.

Broadly classifying the known techniques for forming the improved golf balls, there are such ones as disclosed, for example, in Japanese Patent Publication (Unexamined) Tokkaisho No. 60-96272 and Japanese Patent Publication (Unexamined) Tokkaisho No. 58-25180, wherein the dimension of the dimples, all of which are uniformly formed, that is, the diameter, the depth, the cross section, etc. are tried to be optimum, in Japanese Patent Publication (Examined) Tokkaisho No. 58-50774 and Japanese Patent Publication (Unexamined) Tokkaisho No. 53-115330 wherein the pitch between the two adjacent dimples is set within a given range, and in Japanese Patent Publication (Unexamined) No. 57-107170 according to which all of the dimples are arranged with an equal pitch to each other.

All of the above-described known techniques are commonly based on the premise that all the dimples formed on the surface of a golf ball have the same uniform dimension. This is because of the general conception that the roughness on the spherical surface of the golf ball affects the force of air as the average dimension since the golf ball travels at a high speed of 40–80 m/sec and with a revolution of 2000–10000 rpm in tournament play.

In the meantime, the dimples on the golf ball play the role for accelerating the transition of the disturbed flow of the air in the boundary layer so as to separate the disturbed flow of the air off the golf ball. Accordingly, a golf ball with dimples, in comparison with one without dimples, can be made such that a point of separation is brought further backwards and the separation area is reduced, which in turn leads to the reduction of pressure resistance and the improvement of lift owing to the promotive difference between the upper and the lower separation points. Moreover, the dimples should work all around either when the golf ball travels at lower speeds or when the golf ball travels at high speeds.

However, in a conventional golf ball, for example, as shown in FIG. 9 which is arranged with the dimples (a) each having the same shape and the same size, the air flows in a different way at every position on the surface of the golf ball. More specifically, the flow of the air at the cross sections (e—e), (f—f), (g—g), etc. crossing at right angles with respect to the rotational axis (b) of the ball interferes with each other. Therefore, it might be considered that the dimples work less effectively. In other words, during the travelling of the golf ball in the direction H, the position of each separation points E, F and G respectively at cross sections (e—e), (f—f), (g—g) changes greatly because of the great difference in degrees of the roughness in each cross section, and accordingly, the flow of the air at the cross section (f—f) hinders the flow of the air at the cross section (e—e) and that at the cross section (g—g), thereby deteriorating the effective function of the dimples. On the other hand, the flow of the air at each of the cross sections (e—e), (f—f) and (g—g) is inclined itself to be stabilized and settled in accordance with the dimension of the dimples, which inclination would be due until the golf ball falls down on the ground after it is shot.

Therefore, even when the pattern, the pitch, etc. of the dimples all having the same dimension as shown in FIG. 9 are tried in various ways so as to be optimum, the dimples cannot be effective.

Meanwhile, considering the pattern of the arrangement of the dimples, it is necessary to be non-directional as much as possible, and various proposals have been made for the arrangement pattern of the dimples.

Namely, a first proposal is a golf ball having about 336 dimples arranged in a regular octahedron such as disclosed in Japanese Patent Publication (Unexamined) Tokkaisho No. 60-111665, which has 416 dimples impressed thereon. A second proposal is a golf ball having 360 dimples arranged in the form of regular dodecahedrons. A third proposal is a golf ball having 252 dimples arranged in the form of an affine icosahedron, as is disclosed in Japanese Patent Publication (Unexamined) Tokkaisho No. 49-52029, or a golf ball having 492 dimples impressed therein. Fourthly proposed is a golf ball as is disclosed in Japanese Patent Publication (Unexamined) Tokkaisho No. 58-50744, which has approximately 332 dimples or 392 dimples by the reduction or addition of one row of the seam portion of dimples from or to the arrangement in the form of an icosahedron for the convenience of the molding technique. And, such a golf ball as is disclosed in Japanese Patent Publication (Unexamined) Tokkaisho No. 53-115330 and having about 280–350 dimples arranged in concentric circles is fifthly proposed. A sixth proposal is a golf ball with 320 dimples arranged with an equal pitch between the two adjacent dimples as is disclosed in Japanese Patent Publication (Unexamined) Tokkaisho No. 57-107170.

The arrangement of patterns of the dimples in the above-described proposed, except in the first, second and sixth proposals, are all strongly directional. What is worse, the trajectory differs depending on the rotational axis at the time when the golf ball is shot, and therefore, these proposals, except the first, second and sixth proposals, should be out of the question in view of the non-directionality.

On the other hand, so long as the non-directionality is aimed, the arrangement of the dimples in the form of regular dodecahedrons, regular octahedron are proper, as well as the arrangement in the form of a regular tetrahedron, that in the form of a cube, or in the form of regular icosahedrons, because they are basically the arrangement in the form of a regular polyhedron.

As referred to earlier, the mold of the golf ball is made of two recessed hemispheres. On the seam of the two hemispheres, the dimples cannot be formed.

Accordingly, in view of the foregoing circumstances, only the arrangement in the form of a regular octahedron can be employed for the non-directional arrangement of the dimples (among the five arrangements).

Semi-regular polyhedrons can be also taken into consideration as one example of a polyhedron having edges of the same length. Although there are thirteen semi-regular polyhedrons, only the cubic octahedron and icosa-dodeca hedrons are able to be cut into two pieces, without the circumscribed sphere thereof passing through the planes and, at the planes including only the edges. The cubic octahedron has fourteen planes and the icosa-dodeca hedrons have thirty-two planes. While noting the fact that the number of dimples in a standard golf ball ranges from 250 to 550, it is found that the arrangement in the form of icosa-dodeca hedrons is most suitable for easily realizing the non-directional arrangement.

Although the arrangement in the form of a geodesic polyhedron as described in Japanese Patent Publication (Unexamined) Tokkaisho No. 57-107170 is most promising from the viewpoint of the non-directionality, the number of the dimples able to be impressed in the golf ball is limited to 320, 720, etc. according to this arrangement, and therefore, this arrangement is inconvenient in that the number of the dimples cannot be freely changed. As will be described later, it is most important to change the number of dimples in accordance with the structure of the golf ball or the size of the golf ball in order to make optimum the trajectory of the golf ball and the flight distance. Thus, it can be so decided that the arrangement in the form of icosa-dodeca hedrons is most preferable.

There are considered various kinds of arrangements for the dimples in the form of icosa-dodeca hedrons. However, supposing that the number of the dimples at the five-cornered portions is p, and the number of the dimples at the three-cornered portions is t, the total number N of the dimples is expressed by an equation $N=12p+20t$.

For example, in the case where p is 26 and t is 6, the total number N of the dimples is 432.

One example of how 432 uniform dimples are arranged is shown in FIG. 10.

As stated earlier, the arrangement in the form of icosa-dodeca hedrons is employed with the aim towards the non-directionality in the arrangement. However, even in the arrangement in the form of icosa-dodeca hedrons when the same and uniform dimples are used, discrepancies occur in the position of the separation points E, F and G from each other as shown in FIG. 10, in the same manner as in FIG. 9, resulting in poor stability of the separation points during the travel of the golf ball. The dimples become less effective.

Accordingly, it will be deemed that even with the employment of a good arrangement of the dimples, the dimples all with the same dimension impressed on the surface of the golf ball cannot realize full effect.

SUMMARY OF THE INVENTION

An essential object of the present invention is to provide an improved golf ball which has two to four kinds of dimples having different diameter with arranging the dimples at regular positions over the entire surface of the golf ball, such that the flow of the air at every cross section crossing at right angles to the rotational axis of the golf ball is made equal, and at the same time, the angular difference between separation points is minimized, with substantial elimination of the disadvantage or inconvenience inherent in the prior art golf ball which has only one kind of dimples impressed thereon.

According to the present invention, there is provided a golf ball a spherical surface of which is, supposing that it is a sphere exteriorly connected to semi-regular icosa-dodeca hedrons, divided by imaginary circular arcs reflected on the sphere with edges of the icosa-dodeca hedron into five-cornered divisions and three-cornered divisions, all of said five-cornered divisions being generally uniformly or completely uniformly provided with dimples therein and all of said three-cornered divisions being generally uniformly or completely uniformly provided with dimples therein, wherein said dimples are comprised of two to four kinds of dimples having different diameter from each other, with the ratio of the diameter of the largest dimples with respect to the smallest dimples being set at 1.25 to 1.50.

According to the present invention, since two to four kinds of dimples having different diameter from each other are arranged on the surface of a golf ball in a so-called "regulations with disorderly" fashion, the flow of the air at cross sections crossing at right angles with respect to the rotational axis of the golf ball is made uniform. The angular difference of the separation points is able to be minimized. Consequently, the flow of the air is further more disturbed in the boundary layer on the surface of the golf ball, inviting reduction of the air resistance. That is, the golf ball according to the present invention can travel with less directionality in the rotation thereof, thereby remarkably improving the dimple effect.

Best effects can be obtained most noticeably when the ratio of the diameter of the dimples is set at 1.25–1.50. In the case where the diameter ratio is set lower than 1.25, the diameter of different kinds of dimples becomes equal, and it becomes meaningless that there are formed two to four kinds of different, large and small dimples. On the contrary, if the ratio of the diameter is set at more than 1.50, the diameter of the largest dimples is so large that it becomes necessary to make the depth thereof considerably shallow, which will result in the extreme change of flight characteristics of the golf ball after the ball is repeatedly used. Likewise, the area occupied by the largest dimples becomes increased too much, and the condition may be similar to in the case that only one kind of dimples, namely, only the largest dimples are formed on the surface of the golf ball.

BRIEF DESCRIPTION OF THE DRAWINGS

This and other objects and features of the present invention will become apparent from the following description taken in conjunction with preferred embodiments thereof with reference to the accompanying drawings, in which.

DETAILED DESCRIPTION OF THE INVENTION

Figure 1:
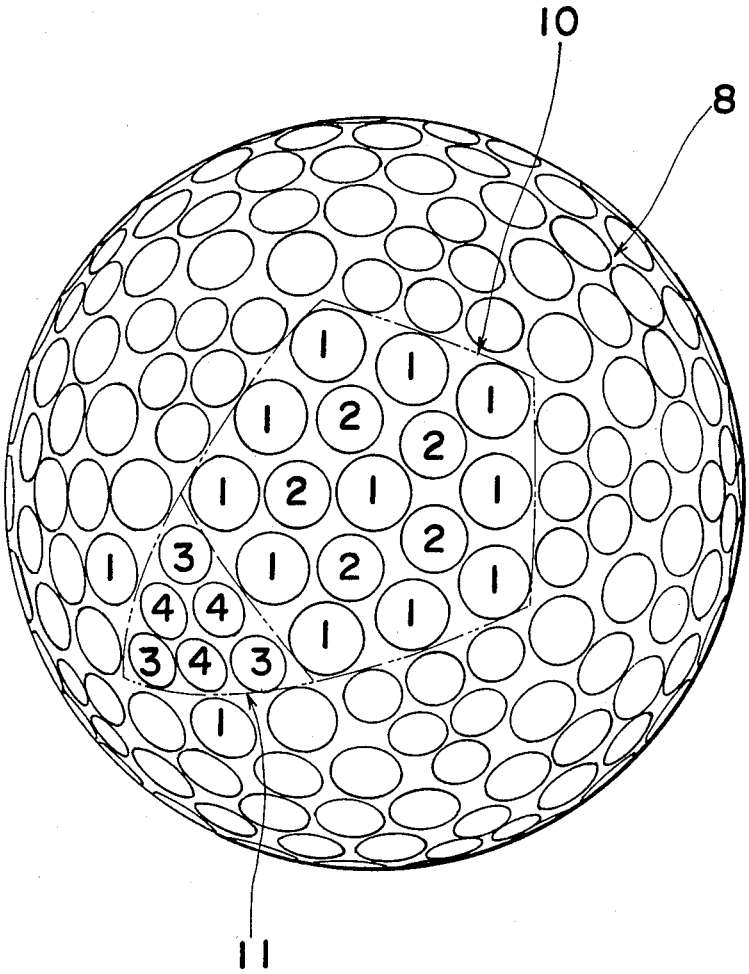
FIGS. 1 to 4 are views of a golf ball showing the arrangement pattern of dimples in accordance with preferred embodiments of the present invention.

Before the description of the present invention proceeds, it is to be noted here that like parts are designated by like reference numerals throughout the accompanying drawings.

Figure 11:
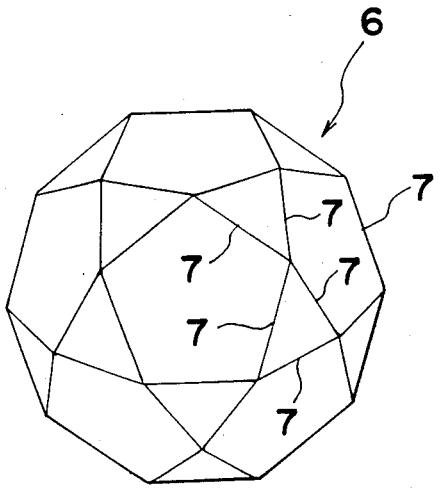
FIG. 11 is a front elevational view of a 20-12 hedron.
Figure 12:
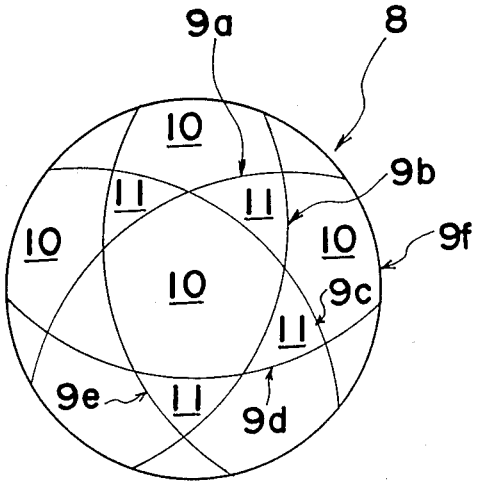
FIG. 12 is a schematic view explanatory of how the spherical surface of the golf ball is divided.

Referring now to FIG. 11, there is shown a 20-12 hedron 6, i.e., icosa-dodeca hedrons, which is a semi-regular polyhedron. An edge 7 of the 20-12 hedron 6 is, when it is reflected on the spherical surface exteriorly connected to the 20-12 hedron 6, supposed to be a circular arc. As shown in FIG. 12, the spherical surface 8 is divided into five-cornered divisions 10 and three-cornered divisions 11 by six circular arcs *9a, 9b, . . . , 9e* and *9f*.

According to the present invention, it is so arranged that all of the dimples are formed so as not to cross the imaginary circular arcs 9. In other words, all of the dimples are arranged in each of the divisions 10 and 11 in such a manner as will be described hereinbelow.

FIGS. 1 to 4 are views of a golf ball showing the arrangement pattern of dimples in accordance with each preferred embodiment of the present invention. In any one of the illustrated embodiments, at least two kinds of different dimples among four kinds of large and small dimples 1, 2, 3 and 4 are arranged generally uniformly or completely uniformly, in an appropriate number, within each of the twelve five-cornered divisions 10. Moreover, at least two kinds of different dimples among the four kinds of different dimples 1, 2, 3 and 4 are arranged generally uniformly or completely uniformly, in an appropriate number, within each of twenty three-cornered divisions 11.

The four kinds of the dimples having a different diameter from each other will be referred to as follows, with the diameter D thereof being determined as follows:

The dimples having the first largest diameter: Largest dimple 1, with the diameter D1, The dimples having the second largest diameter: Large dimple 2, with the diameter D2, The dimples having the third largest diameter: Small dimple 3, with the diameter D3, The dimples having the fourth largest diameter: Smallest dimple 4, with the diameter D4.

It is to be noted here that the ratio of the largest diameter D1 with respect to the smallest diameter D4 is given as follows:

$$D1/D4 = 1.25\text{–}1.50 \quad (1)$$

Moreover, it is also to be noted that a smallest dimple 4 is so arranged as to be always next to more than one largest dimple 1. Consequent to this, the spherical surface 8 of the golf ball can be prevented from being irregularly rough which would happen when the smallest dimples are aggregatively gathered. It is preferable that the interval between the dimples 1, 2, 3 and 4 is set at 0–0.5 mm.

Further, it is most desirable that the sum of the number of the largest dimples 1 with the number of the large dimples 2 occupies 55–75% of the total number N of the dimples.

In any embodiments shown in FIGS. 1 to 4, the total dimples volume defined by the following equation should be set within the range of 250 to 400 mm$^3$. The total dimples volume means a sum of volumes of all dimples provided all over the surface of golf ball, wherein the volume of dimple is taken as a volume of room surrounded by the bottom surface of dimple and the under surface of a plane plate to be imaginary covered onto the opening of dimple.

$$V_T = V_1 + V_2 + V_3 + V_4 \quad (2)$$

$$V_1 = \frac{0.001}{12} N_1\pi \left\{ \sum_{k=1}^{n-1} (E1_{k-1} \cdot E1_k + 2E1_k^2) \right\}$$

$$V_2 = \frac{0.001}{12} N_2\pi \left\{ \sum_{k=1}^{n-1} (E2_{k-1} \cdot E2_k + 2E2_k^2) \right\}$$

$$V_3 = \frac{0.001}{12} N_3\pi \left\{ \sum_{k=1}^{n-1} (E3_{k-1} \cdot E3_k + 2E3_k^2) \right\}$$

$$V_4 = \frac{0.001}{12} N_4\pi \left\{ \sum_{k=1}^{n-1} (E4_{k-1} \cdot E4_k + 2E4_k^2) \right\}$$

wherein:

$V_T$=total dimples volume, $V_1$=total dimples volume of largest dimple 1, $V_2$=total dimples volume of large dimple 2, $V_3$=total dimples volume of small dimple 3, $V_4$=total dimples volume of smallest dimple 4, $N_1$=total number of largest dimple 1, $N_2$=total number of large dimple 2, $N_3$=total number of small dimple 3, $N_4$=total number of smallest dimple 4, $E1_k$=diameter of largest dimple 1 at point descended in a direction of depth of k microns from the dimple edge (mm), $E2_k$=diameter of large dimple 2 at point descended in a direction of depth of k microns from the dimple edge (mm), $E3_k$=diameter of small dimple 3 at point descended in a direction of depth of k microns from the dimple edge (mm), $E4_k$=diameter of smallest dimple 4 at point descended in a direction of depth of k microns from the dimple edge (mm), n=depth of dimple (microns).

It is to be noted here that in the present invention, the number of each kind of the dimples may be more or less varied because some of the dimples are abbreviated for imprinting a brand name on the surface of the golf ball or because of the structural reason, and therefore, "approximately" in the present invention implies such significance that the number of the dimples may be slightly increased or decreased.

Next, a golf ball in accordance with preferred embodiments 1 to 17 of the present invention will be tabulated, together with respective specifications and the arrangement pattern of dimples, in Tables 1 to 4.

TABLE 1

Kinds of Balls Employed in Test 1
Results of Test 1 (Small-size, two-piece ball)

Figure 2:
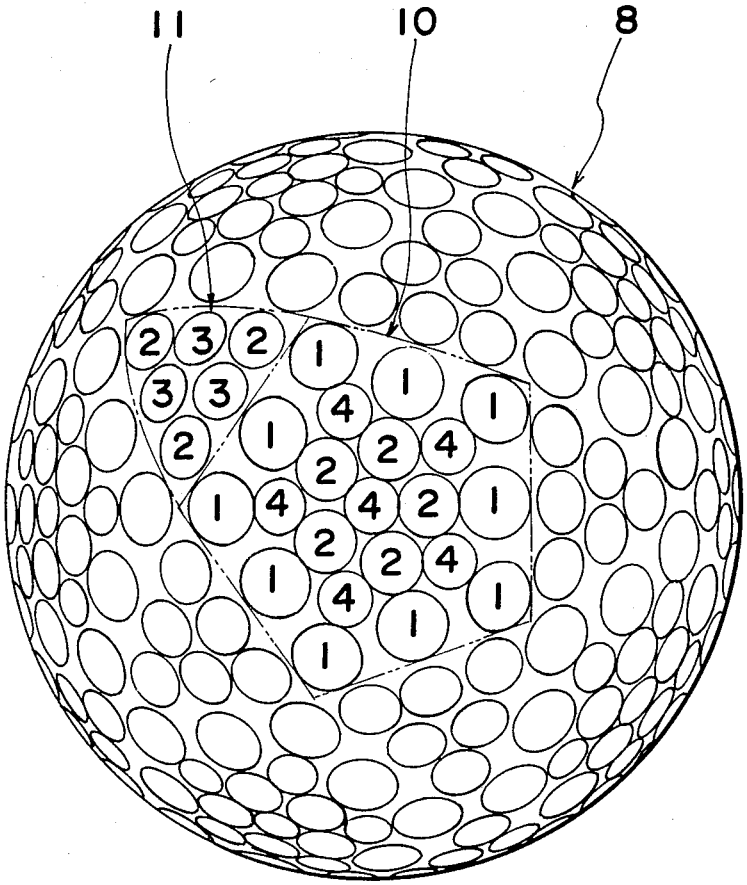
Figure 3:
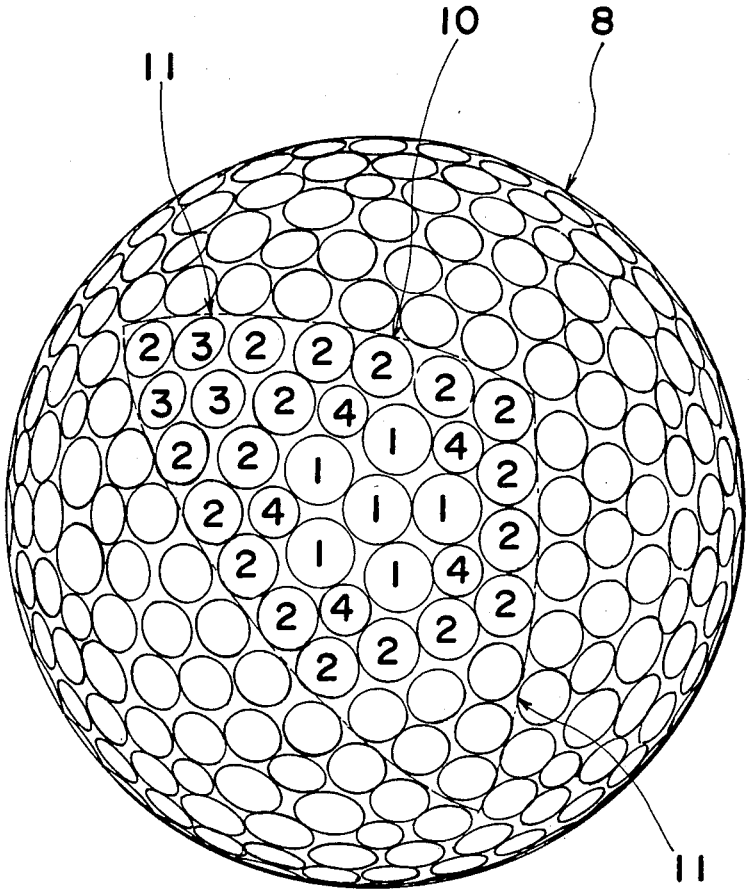
Figure 4:
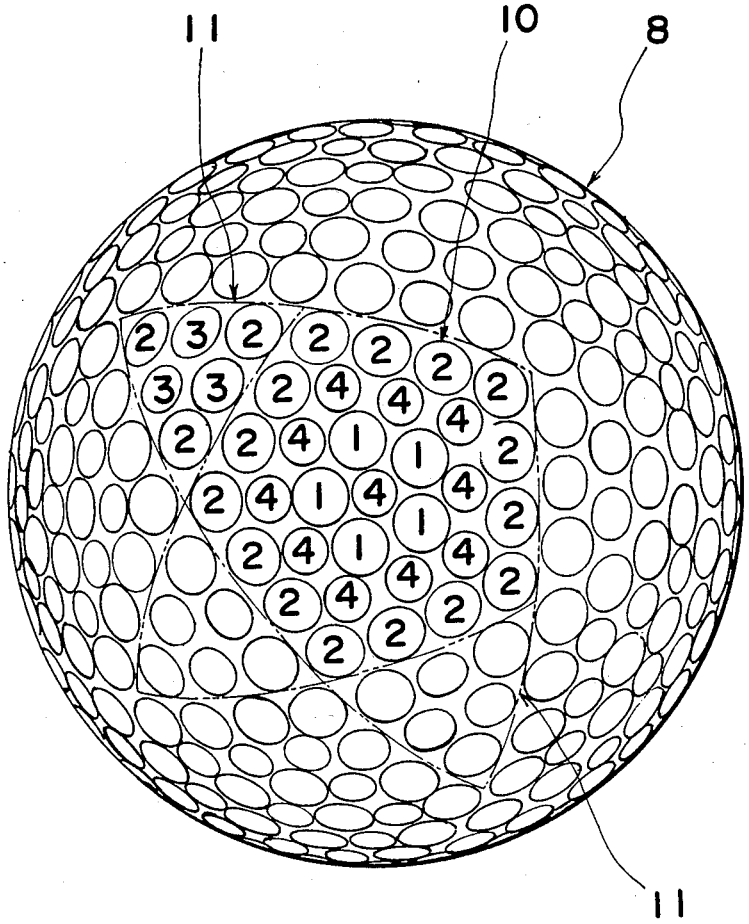
Figure 5:
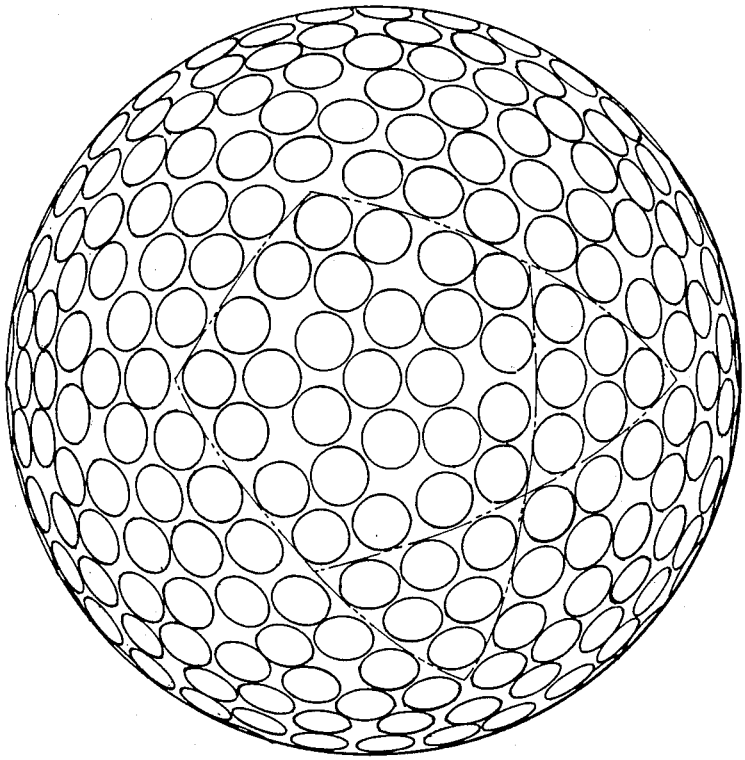
FIGS. 5 to 8 are views of a golf ball respectively showing the arrangement pattern of dimples in accordance with comparative examples.
Figure 6:
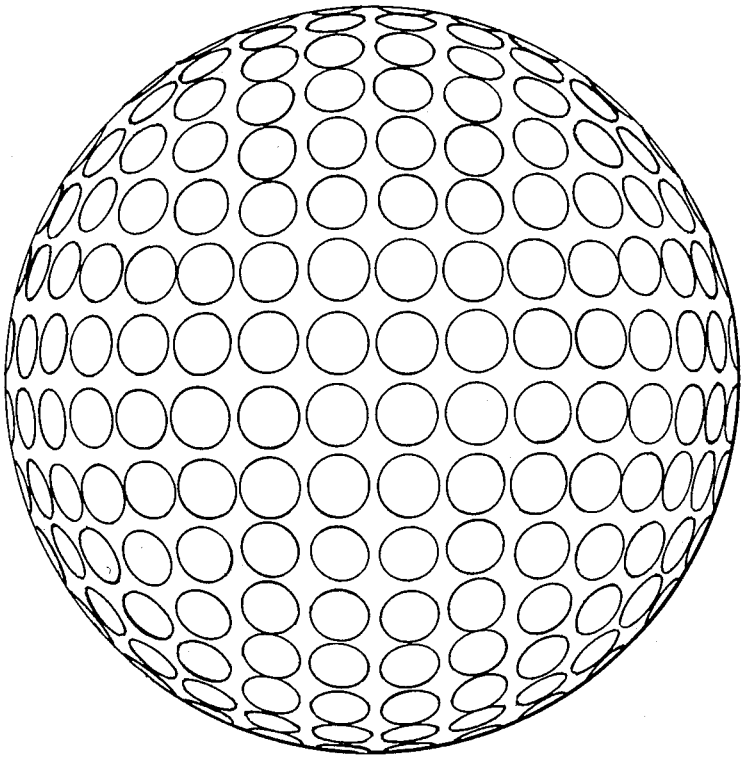
Fig. 6 PRIOR ART
Figure 7:
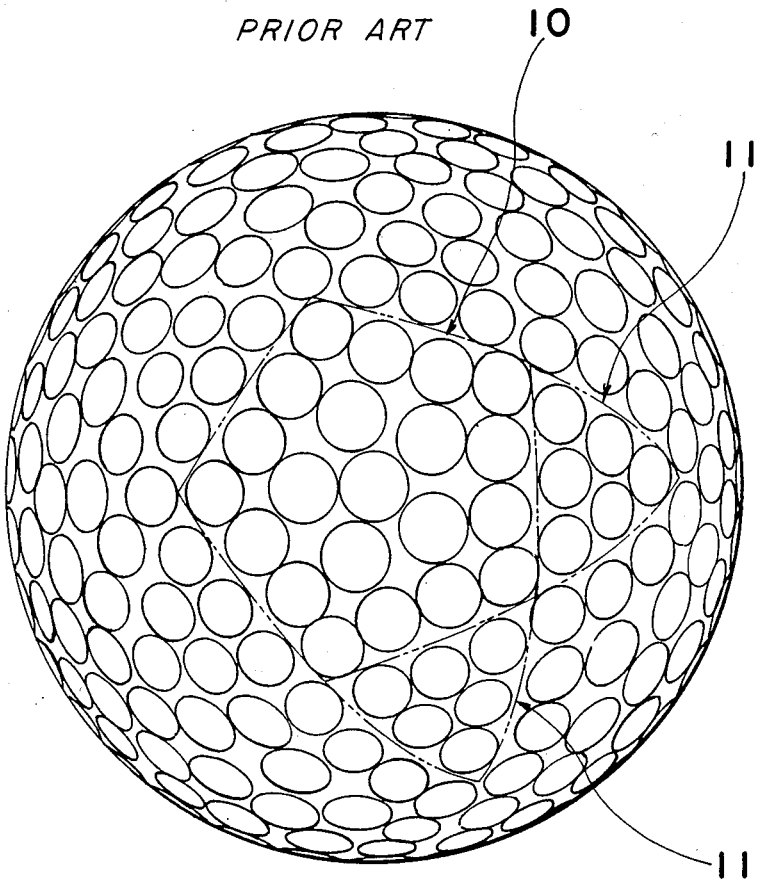
Fig. 7 PRIOR ART

| Embodiment/Comparison | | | Emb. 1 | Emb. 2 | Emb. 3 | Emb. 4 | Comp. 1 | Comp. 2 | Comp. 3 |
|---|---|---|---|---|---|---|---|---|---|
| Corresponding Drawing | | | FIG. 1 | FIG. 2 | FIG. 3 | FIG. 4 | FIG. 6 | FIG. 7 | FIG. 5 |
| Total number of Dimples | | | 312 | 372 | 432 | 492 | 336 | 372 | 432 |
| Dimple | 1st largest | Diam | 4.3 | 4.2 | 4.0 | 3.7 | 3.5 | 3.9 | 3.5 |
| | | Depth | 0.15 | 0.13 | 0.12 | 0.14 | 0.26 | 0.13 | 0.16 |

TABLE 1-continued

| Kinds of Balls Employed in Test 1 Results of Test 1 (Small-size, two-piece ball) | | | | | | | | | |
|---|---|---|---|---|---|---|---|---|---|
| Embodiment/Comparison | | | Emb. 1 | Emb. 2 | Emb. 3 | Emb. 4 | Comp. 1 | Comp. 2 | Comp. 3 |
| Corresponding Drawing | | | FIG. 1 | FIG. 2 | FIG. 3 | FIG. 4 | FIG. 6 | FIG. 7 | FIG. 5 |
| Total number of Dimples | | | 312 | 372 | 432 | 492 | 336 | 372 | 432 |
| | | Number | 132 | 120 | 72 | 60 | 336 | 72 | 432 |
| | 2nd largest | Diam | 3.9 | 3.6 | 3.7 | 3.4 | — | 3.6 | — |
| | | Depth | 0.17 | 0.16 | 0.13 | 0.15 | — | 0.15 | — |
| | | Number | 60 | 120 | 240 | 240 | — | 120 | — |
| | 3rd largest | Diam | 3.6 | 3.3 | 3.4 | 3.3 | — | 3.5 | — |
| | | Depth | 0.18 | 0.17 | 0.15 | 0.15 | — | 0.15 | — |
| | | Number | 60 | 60 | 60 | 60 | — | 120 | — |
| | smallest | Diam | 3.2 | 3.0 | 3.0 | 2.8 | — | 3.2 | — |
| | | Depth | 0.19 | 0.17 | 0.15 | 0.17 | — | 0.16 | — |
| | | Number | 60 | 72 | 60 | 132 | — | 60 | — |
| | 1st largest/smallest ratio | | 1.34 | 1.40 | 1.33 | 1.32 | 1.00 | 1.22 | 1.00 |
| | Total dimples volume ($mm^3$) | | 320 | 323 | 322 | 325 | 327 | 319 | 324 |
| Head velocity 49 m/sec | Carry (m) | | 237 | 235 | 232 | 228 | 224 | 227 | 223 |
| | Run (m) | | 19 | 21 | 22 | 24 | 19 | 21 | 23 |
| | Total (m) | | 256 | 256 | 254 | 252 | 243 | 248 | 246 |
| | Trajectory Height* | | 5.7 | 5.5 | 5.4 | 5.1 | 5.6 | 5.5 | 5.2 |
| | Flight endurance or staying time (sec) | | 5.78 | 5.72 | 5.66 | 5.49 | 5.77 | 5.69 | 5.44 |
| Head velocity 45 m/sec | Carry | | 216 | 214 | 211 | 209 | 207 | 208 | 206 |
| | Run | | 20 | 23 | 24 | 26 | 21 | 22 | 24 |
| | Total | | 236 | 237 | 235 | 235 | 228 | 228 | 228 |
| | Trajectory Height | | 6.1 | 6.0 | 5.8 | 5.5 | 6.0 | 5.9 | 5.5 |
| | Flight endurance | | 5.49 | 5.41 | 5.32 | 5.19 | 5.44 | 5.39 | 5.01 |
| Head velocity 40 m/sec | Carry | | 185 | 184 | 182 | 179 | 175 | 175 | 175 |
| | Run | | 21 | 22 | 23 | 25 | 21 | 22 | 24 |
| | Total | | 206 | 206 | 205 | 204 | 196 | 197 | 199 |
| | Trajectory Height | | 6.5 | 6.4 | 6.2 | 6.0 | 6.4 | 6.4 | 5.8 |
| | Flight endurance | | 5.09 | 5.04 | 4.98 | 4.86 | 5.06 | 5.00 | 4.89 |

*NOTE:
The height of trajectory is an index, and the real height thereof (m) is a result of the height of trajectory multiplied by a constant.

TABLE 2

| Kinds of Balls Employed in Test 2 Results of Test 2 (Large-size, two-piece ball) | | | | | | | | | |
|---|---|---|---|---|---|---|---|---|---|
| Embodiment/Comparison | | | Emb. 5 | Emb. 6 | Emb. 7 | Emb. 8 | Comp. 4 | Comp. 5 | Comp. 6 |
| Corresponding Drawing | | | FIG. 1 | FIG. 2 | FIG. 3 | FIG. 4 | FIG. 6 | FIG. 7 | FIG. 5 |
| Total number of Dimples | | | 312 | 372 | 432 | 492 | 336 | 372 | 432 |
| Dimple | 1st largest | Diam | 4.4 | 4.3 | 4.1 | 3.8 | 3.6 | 34.0 | 3.6 |
| | | Depth | 0.16 | 0.14 | 0.14 | 0.15 | 0.25 | 0.14 | 0.17 |
| | | Number | 132 | 120 | 72 | 60 | 336 | 72 | 432 |
| | 2nd largest | Diam | 4.0 | 3.7 | 3.8 | 3.5 | — | 3.7 | — |
| | | Depth | 0.18 | 0.16 | 0.15 | 0.16 | — | 0.16 | — |
| | | Number | 60 | 120 | 240 | 240 | — | 120 | — |
| | 3rd largest | Diam | 3.7 | 3.4 | 3.5 | 3.4 | — | 3.6 | — |
| | | Depth | 0.19 | 0.17 | 0.16 | 0.16 | — | 0.16 | — |
| | | Number | 60 | 60 | 60 | 60 | — | 120 | — |
| | smallest | Diam | 3.2 | 3.1 | 3.1 | 2.9 | — | 3.3 | — |
| | | Depth | 0.20 | 0.18 | 0.17 | 0.17 | — | 0.17 | — |
| | | Number | 60 | 72 | 60 | 132 | — | 60 | — |
| | 1st largest/smallest ratio | | 1.38 | 1.39 | 1.32 | 1.31 | 1.00 | 1.21 | 1.00 |
| | Total dimples volume ($mm^3$) | | 360 | 363 | 367 | 369 | 370 | 362 | 367 |
| Head velocity 49 m/sec | Carry (m) | | 236 | 237 | 234 | 230 | 225 | 228 | 226 |
| | Run (m) | | 14 | 18 | 21 | 23 | 16 | 18 | 20 |
| | Total (m) | | 250 | 255 | 255 | 253 | 241 | 246 | 246 |
| | Trajectory Height* | | 5.9 | 5.7 | 5.5 | 5.4 | 5.8 | 5.6 | 5.3 |
| | Flight endurance or staying time (sec) | | 5.92 | 5.86 | 5.79 | 5.62 | 5.91 | 5.75 | 5.49 |
| Head velocity 45 m/sec | Carry | | 214 | 215 | 213 | 210 | 206 | 208 | 206 |
| | Run | | 16 | 20 | 23 | 24 | 17 | 19 | 21 |
| | Total | | 230 | 235 | 236 | 234 | 223 | 227 | 227 |
| | Trajectory Height | | 6.3 | 6.1 | 6.0 | 5.8 | 6.2 | 6.0 | 5.7 |
| | Flight endurance | | 5.58 | 5.51 | 5.43 | 5.32 | 5.55 | 5.46 | 5.14 |
| Head velocity 40 m/sec | Carry | | 183 | 183 | 181 | 178 | 176 | 177 | 175 |
| | Run | | 18 | 20 | 22 | 23 | 19 | 20 | 22 |
| | Total | | 201 | 203 | 203 | 201 | 195 | 197 | 196 |
| | Trajectory Height | | 6.7 | 6.6 | 6.4 | 6.2 | 6.6 | 6.5 | 6.0 |
| | Flight endurance | | 5.21 | 5.11 | 5.03 | 4.89 | 5.17 | 5.06 | 4.69 |

*NOTE:
The height of trajectory is an index, and the real height thereof (m) is a result of the height of trajectory multiplied by a constant.

TABLE 3

Kinds of Balls Employed in Test 3
Results of Test 3 (Small-size, thread-wound ball)

| Embodiment/Comparison | | | Emb. 9 | Emb. 10 | Emb. 11 | Emb. 12 | Emb. 13 | Comp. 7 |
|---|---|---|---|---|---|---|---|---|
| Corresponding Drawing | | | FIG. 1 | FIG. 2 | FIG. 3 | FIG. 4 | Mod. of FIG. 4 | FIG. 5 |
| Total number of Dimples | | | 312 | 372 | 432 | 492 | 480 | 432 |
| Dimple | 1st largest | Diam | 4.4 | 4.2 | 4.0 | 3.7 | 3.7 | 3.5 |
| | | Depth | 0.18 | 0.15 | 0.15 | 0.15 | 0.15 | 0.16 |
| | | Number | 132 | 120 | 72 | 60 | 60 | 432 |
| | 2nd largest | Diam | 3.9 | 3.6 | 3.6 | 3.4 | 3.4 | — |
| | | Depth | 0.20 | 0.17 | 0.16 | 0.16 | 0.16 | — |
| | | Number | 60 | 120 | 240 | 240 | 240 | — |
| | 3rd largest | Diam | 3.6 | 3.3 | 3.3 | 3.3 | 3.3 | — |
| | | Depth | 0.21 | 0.18 | 0.18 | 0.16 | 0.16 | — |
| | | Number | 60 | 60 | 60 | 60 | 60 | — |
| | smallest | Diam | 3.2 | 3.0 | 3.0 | 2.8 | 2.8 | — |
| | | Depth | 0.23 | 0.19 | 0.18 | 0.18 | 0.18 | — |
| | | Number | 60 | 72 | 60 | 132 | 120 | — |
| | 1st largest/smallest ratio | | 1.38 | 1.40 | 1.33 | 1.32 | 1.32 | 1.00 |
| | Total dimples volume ($mm^3$) | | 350 | 342 | 335 | 330 | 320 | 335 |
| Head velocity 49 m/sec | Carry (m) | | 235 | 236 | 234 | 231 | 232 | 225 |
| | Run (m) | | 15 | 18 | 20 | 22 | 21 | 22 |
| | Total (m) | | 250 | 254 | 254 | 253 | 253 | 247 |
| | Trajectory Height* | | 5.9 | 5.8 | 5.6 | 5.4 | 5.5 | 5.5 |
| | Flight endurance or staying time (sec) | | 5.88 | 5.79 | 5.71 | 5.67 | 5.72 | 5.58 |
| Head velocity 45 m/sec | Carry | | 213 | 214 | 213 | 211 | 212 | 205 |
| | Run | | 17 | 20 | 22 | 23 | 22 | 21 |
| | Total | | 230 | 234 | 235 | 234 | 234 | 226 |
| | Trajectory Height | | 6.3 | 6.1 | 6.0 | 5.7 | 5.8 | 5.7 |
| | Flight endurance | | 5.59 | 5.52 | 5.46 | 5.33 | 5.39 | 5.29 |
| Head velocity 40 m/sec | Carry | | 183 | 184 | 183 | 180 | 181 | 175 |
| | Run | | 20 | 21 | 23 | 23 | 22 | 23 |
| | Total | | 203 | 205 | 206 | 203 | 204 | 198 |
| | Trajectory Height | | 6.6 | 6.5 | 6.3 | 6.1 | 6.2 | 6.1 |
| | Flight endurance | | 5.31 | 5.20 | 5.12 | 5.00 | 5.04 | 4.98 |

*NOTE:
The height of trajectory is an index, and the real height thereof (m) is a result of the height of trajectory multiplied by a constant.

TABLE 4

Kinds of Balls Employed in Test 4
Results of Test 4 (Large-size, thread-wound ball)

Figure 8:
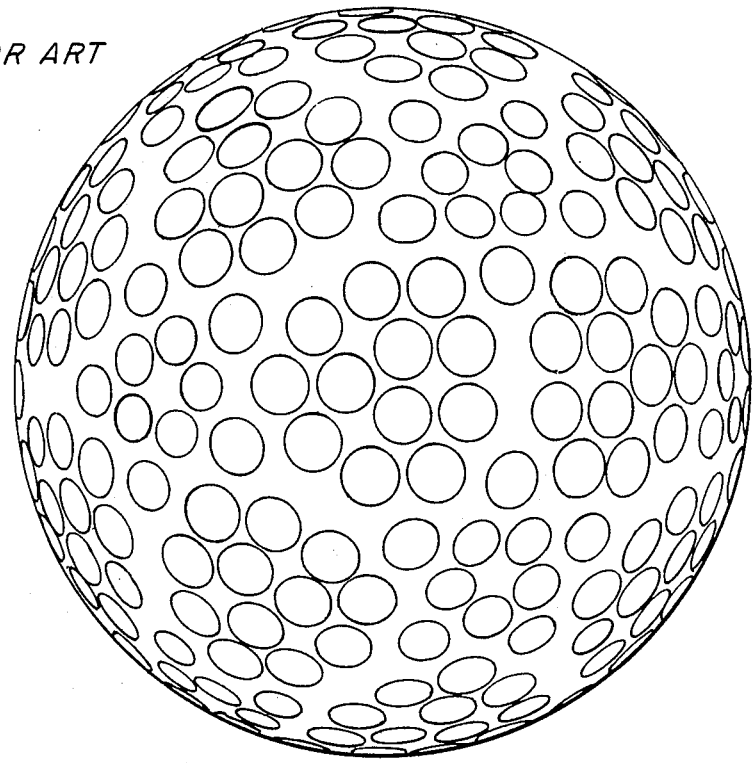
Fig. 8 PRIOR ART
Figure 9:
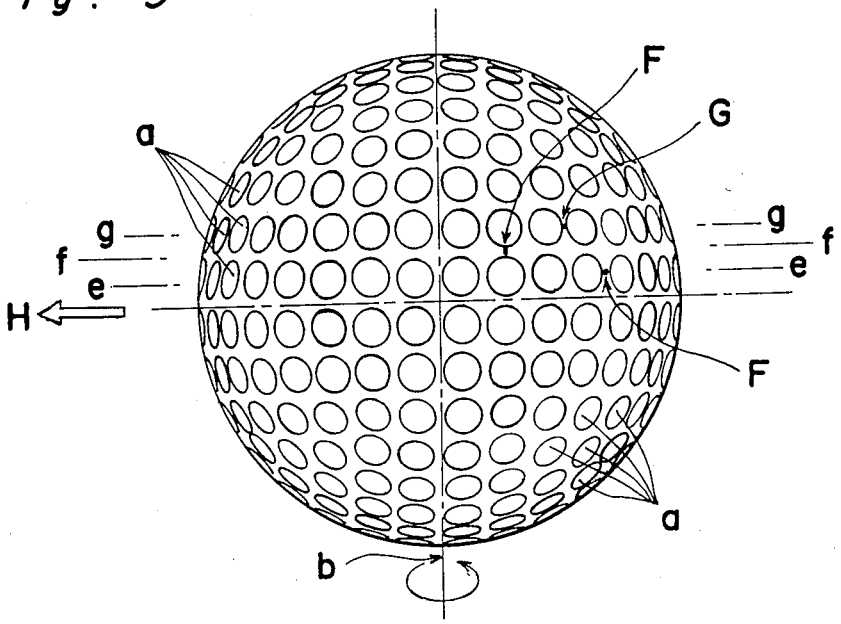
FIG. 9 is a plan view of a prior art golf ball explanatory of the disadvantage in the arrangement of the dimples.
Figure 10:
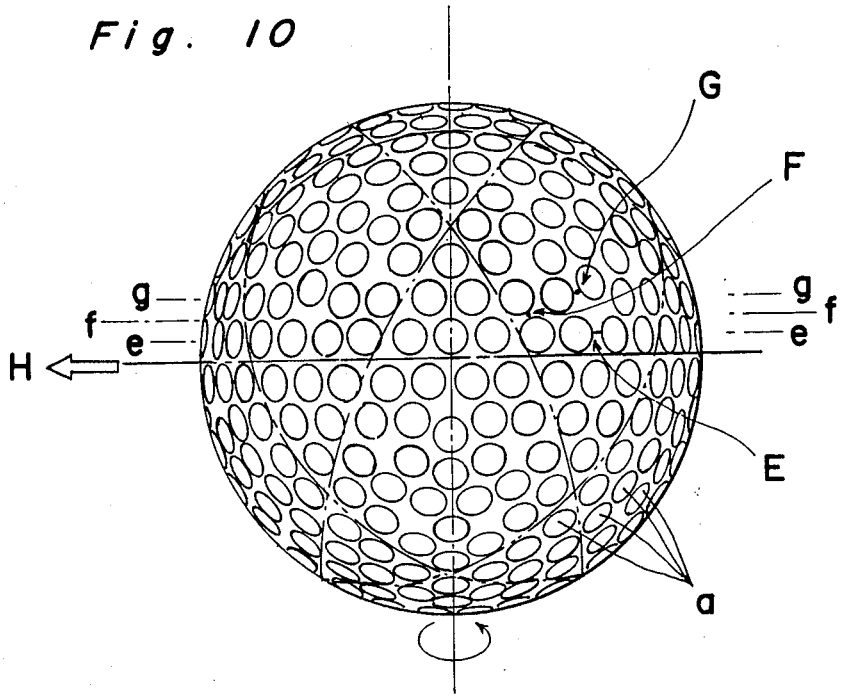
FIG. 10 is a view of a golf ball explanatory of the disadvantage in the arrangement pattern of dimples in the case that one kind of dimples are equally spaced in the form of 20-12 hedron.

| Embodiment/Comparison | | | Emb. 14 | Emb. 15 | Emb. 16 | Emb. 17 | Comp. 8 | Comp. 9 |
|---|---|---|---|---|---|---|---|---|
| Corresponding Drawing | | | FIG. 1 | FIG. 2 | FIG. 3 | FIG. 4 | FIG. 5 | FIG. 8 |
| Total number of Dimples | | | 312 | 372 | 432 | 492 | 432 | 360 |
| Dimple | 1st largest | Diam | 4.5 | 4.3 | 4.1 | 3.8 | 3.6 | 3.43 |
| | | Depth | 0.19 | 0.16 | 0.16 | 0.16 | 0.17 | 0.28 |
| | | Number | 132 | 120 | 72 | 60 | 432 | 120 |
| | 2nd largest | Diam | 4.0 | 3.7 | 3.7 | 3.5 | — | 3.18 |
| | | Depth | 0.21 | 0.18 | 0.17 | 0.17 | — | 0.28 |
| | | Number | 60 | 120 | 240 | 240 | — | 120 |
| | 3rd largest | Diam | 3.7 | 3.4 | 3.4 | 3.4 | — | 3.05 |
| | | Depth | 0.22 | 0.19 | 0.18 | 0.17 | — | 0.28 |
| | | Number | 60 | 60 | 60 | 60 | — | 60 |
| | smallest | Diam | 3.3 | 3.1 | 3.1 | 2.9 | — | 2.80 |
| | | Depth | 0.24 | 0.20 | 0.19 | 0.19 | — | 0.28 |
| | | Number | 60 | 72 | 60 | 132 | — | 60 |
| | 1st largest/smallest ratio | | 1.36 | 1.39 | 1.32 | 1.31 | 1.00 | 1.22 |
| | Total dimples volume ($mm^3$) | | 385 | 379 | 377 | 368 | 376 | 401 |
| Head velocity 49 m/sec | Carry (m) | | 234 | 235 | 237 | 234 | 225 | 227 |
| | Run (m) | | 12 | 14 | 16 | 19 | 18 | 16 |
| | Total (m) | | 246 | 249 | 253 | 253 | 243 | 243 |
| | Trajectory Height* | | 6.2 | 5.9 | 5.7 | 5.4 | 5.4 | 5.7 |
| | Flight endurance or staying time (sec) | | 6.09 | 5.98 | 5.91 | 5.78 | 5.61 | 5.86 |
| Head velocity 45 m/sec | Carry | | 211 | 212 | 213 | 210 | 203 | 205 |
| | Run | | 15 | 16 | 17 | 21 | 19 | 18 |
| | Total | | 226 | 228 | 230 | 231 | 222 | 223 |
| | Trajectory Height | | 6.5 | 6.4 | 6.1 | 5.8 | 5.7 | 6.0 |
| | Flight endurance | | 5.72 | 5.65 | 5.56 | 5.43 | 5.27 | 5.60 |
| Head velocity 40 m/sec | Carry | | 180 | 181 | 183 | 181 | 173 | 176 |
| | Run | | 18 | 19 | 20 | 22 | 21 | 18 |
| | Total | | 198 | 200 | 203 | 203 | 194 | 194 |
| | Trajectory Height | | 6.8 | 6.7 | 6.5 | 6.3 | 6.3 | 6.6 |

TABLE 4-continued

| Kinds of Balls Employed in Test 4 Results of Test 4 (Large-size, thread-wound ball) | | | | | | |
|---|---|---|---|---|---|---|
| Embodiment/Comparison | Emb. 14 | Emb. 15 | Emb. 16 | Emb. 17 | Comp. 8 | Comp. 9 |
| Corresponding Drawing | FIG. 1 | FIG. 2 | FIG. 3 | FIG. 4 | FIG. 5 | FIG. 8 |
| Total number of Dimples | 312 | 372 | 432 | 492 | 432 | 360 |
| Flight endurance | 5.49 | 5.39 | 5.32 | 5.18 | 5.06 | 5.35 |

*NOTE:
The height of trajectory is an index, and the real height thereof (m) is a result of the height of trajectory multiplied by a constant.

Hereinbelow, the explanation of the 1st to 17th embodiments and the comparative examples 1 to 9 will be added in more detail.

EMBODIMENTS 1–4

A small-size, two-piece ball is used, the structure of which follows that disclosed in embodiment 1 of Japanese Patent Publication (Unexamined) Tokkaisho No. 59-57675, and the specifications of which are indicated in Table 1.

Embodiment 1: The arrangement pattern of dimples shown in FIG. 1,

Embodiment 2: The arrangement pattern of dimples shown in FIG. 2,

Embodiment 3: The arrangement pattern of dimples shown in FIG. 3, and

Embodiment 4: The arrangement pattern of dimples shown in FIG. 4.

EMBODIMENTS 5–8

A large-size, two-piece ball is employed, the structure of which follows that disclosed in embodiment 1 of Japanese Patent Publication (Unexamined) Tokkaisho No. 59-57675, and the specifications of which are indicated in Table 2.

Embodiment 5: The arrangement pattern of dimples shown in FIG. 1,

Embodiment 6: The arrangement pattern of dimples shown in FIG. 2,

Embodiment 7: The arrangement pattern of dimples shown in FIG. 3, and

Embodiment 8: The arrangement pattern of dimples shown in FIG. 4.

EMBODIMENTS 9–13

A small-size, thread-wound ball which is covered with a coloring material added to Surlyn #1605 (Du Pont, Inc.) is used. The center of the ball is a 28.5 mm solid center. The ball has a hardness of 95 and an initial velocity of 252 ft/sec, with detailed specifications as shown in Table 3.

Embodiment 9: The arrangement pattern of dimples shown in FIG. 1,

Embodiment 10: The arrangement pattern of dimples shown in FIG. 2,

Embodiment 11: The arrangement pattern of dimples shown in FIG. 3,

Embodiment 12: The arrangement pattern of dimples shown in FIG. 4, and

Embodiment 13: The arrangement pattern formed in the manner that the smallest dimple 4 at the center of the five-cornered division 10 is omitted from the arrangement pattern of FIG. 4. Therefore, the total number N of the dimples in this embodiment 13 is smaller by 12 than that of the arrangement pattern in FIG. 4.

EMBODIMENTS 14–17

A large-size, thread-wound ball, the center of which is a 30.5 mm solid center and which is covered with a coloring material added to Surlyn #1605 (Du Pont, Inc.), is employed. The ball has a hardness of 95 and an initial velocity of 254 ft/sec, with specifications indicated in Table 4.

Embodiment 14: The arrangement pattern of dimples shown in FIG. 1,

Embodiment 15: The arrangement pattern of dimples shown in FIG. 2,

Embodiment 16: The arrangement pattern of dimples shown in FIG. 3, and

Embodiment 17: The arrangement pattern of dimples shown in FIG. 4.

COMPARATIVE EXAMPLES 1–3

A small-size, two-piece ball is employed in these examples 1–3. The structure of the ball is the same as that used in Embodiments 1–4. The specifications of the ball are indicated in Table 1.

Comparative Example 1: The arrangement in the form of octahedron shown in FIG. 6, with the use of one kind of dimples, Comparative Example 2: The arrangement pattern shown in FIG. 7, in which four kinds of dimples are arranged in the form of 20-12 hedron. The diameter ratio of the largest dimple with respect to the smallest dimple 3 is as small as 1.22.

Comparative Example 3: The arrangement pattern shown in FIG. 5, according to which one kind of 432 dimples are arranged in the form of 20-12 hedron.

COMPARATIVE EXAMPLES 4–6

A small-size, two-piece ball is used, the structure of which is the same as that in Embodiments 5–8, the specifications of which are indicated in Table 2.

Comparative Example 4: One kind of dimples arranged in the form of an octahedron shown in FIG. 6, Comparative Example 5: The arrangement pattern of FIG. 7, in which four kinds of dimples are arranged in the form of 20-12 hedron. The diameter ratio of the largest dimple with respect to the smallest dimple 3 is as small as 1.21.

Comparative Example 6: The arrangement pattern of FIG. 5, in which one kind of 432 dimples are arranged in the form of 20-12 hedron.

COMPARATIVE EXAMPLE 7

Comparative Example 7: A small-size, thread-wound ball, which has the same solid center and the same covering as in Embodiments 9–13, is used. Both the hardness and the initial velocity of the ball are made equal to those of Embodiments 9–13. And one kind of 432 dimples with the specifications indicated in Table 3 and the arrangement pattern shown in FIG. 5 are arranged in the form of 20-12 hedron.

COMPARATIVE EXAMPLES 8 AND 9

A large-size, thread-wound ball is employed. The structure, material, hardness and velocity of the ball used in these Comparative Examples 8 and 9 are made the same as those of Embodiments 14–17.

Comparative Example 8: The arrangement pattern shown in FIG. 5. One kind of 432 dimples are arranged in the form of 20-12 hedron.

Comparative Example 9: The arrangement pattern of dimples shown in FIG. 8. Specifically, four kinds of 360 dimples are arranged (not in the form of 20-12 hedron, but) in the form of 12 hedron, and therefore, flat divisions without dimples are arranged on spherical surface of the ball.

Comparative tests were performed for clarifying the advantage of Embodiments 1–17 of the present invention, with the use of Comparative Examples 1–9. The results of the comparative tests are represented in Tables 1–4.

It is to be noted here that, for the comparative tests, a swing machine of True Temper Co., Ltd. of the U.S.A. was used. It is also to be noted that flight tests were conducted with a No. 1 wood club in compliance with the test procedure defined by the ODS (Overall Distance Standard) of the USGA (United States Golf Association), when only the head initial velocity was changed into 49 m/sec, 45 m/sec or 40 m/sec. The difference in the flight and the total distance was measured. Moreover, the difference was an average value after 20 balls of each kind were tested.

The tests were classified into four tests, that is, Test 1 (Table 1), Test 2 (Table 2), Test 3 (Table 3) and Test 4 (Table 4). The results of each test will be analyzed in a detailed manner hereinbelow.

Results of Test 1 (referring to Table 1)

(a) In Embodiments 1–4, in comparison with Comparative Examples 1–3, 1–14 m increase of carry and 4–13 m increase of total distance were achieved, at the head velocity of 49 m/sec, the launch angle of 9.6° and the spin of 2700 rpm.

(b) In Embodiments 1–4, compared with Comparative Examples 1–3, 1–10 m increase of carry and 7–9 m increase of total distance were achieved, under the condition that the head velocity was 45 m/sec, the launch angle was 11.1° and the spin was 2900 rpm.

(c) In Embodiments 1–4, in comparison with Comparative Examples 1–3, 4–10 m increase of carry and 5–10 m increase of total distance were achieved, under the condition that the head velocity was 40 m/sec, with the launch angle of 12.7° and the spin of 2900 rpm.

(d) Accordingly, in any case where the head velocity was 49 m/sec, 45 m/sec, or 40 m/sec, the flight distance was remarkably increased according to Embodiments 1–4.

(e) Particularly, the increase of carry could be most remarkably obtained in Embodiment 1.

(f) In Embodiment 2, the trajectory was lower than that in Embodiment 1, which Embodiment 2 showed a better result in the increase of the total distance.

(g) Therefore, it will be conceded that Embodiment 2 with 372 dimples is preferable for a lower trajectory, while Embodiment 1 with 312 dimples is most desirable for a higher trajectory.

Results of Test 2 (referring to Table 2)

(a) In Embodiments 5–8, in comparison with Comparative Examples 4–6, 2–12 m increase of carry and 4–14 m increase of total distance were achieved under the condition that the head velocity was 49 m/sec, the launch angle was 9.7° and the spin was 2800 rpm.

(b) In Embodiments 5–8, in comparison with Comparative Examples 4–6, 2–9 m increase of carry and 3–13 m increase of total distance were achieved under the condition that the head velocity was 45 m/sec, the launch angle was 11.2°, and the spin was 3000 rpm.

(c) In Embodiments 5–8, in comparison with Comparative Examples 4–6, 1–8 m increase of carry and 4–8 m increase of total distance were achieved, under the condition that the head velocity was 40 m/sec, the launch angle was 12.9° and the spin was 3000 rpm.

(d) Accordingly, in any case where the head velocity was 49 m/sec, 45 m/sec, or 40 m/sec, the flight distance was considerably increased according to Embodiments 5–8.

(e) Particularly, the most effective increase in the carry was noticed in Embodiment 6.

(f) On the other hand, in accordance with Embodiment 7, the total distance was highly increased, with the lower trajectory.

(g) Therefore, the golf ball with 432 dimples in accordance with Embodiment 7 is suitable for the lower trajectory, while the golf ball with 372 dimples in accordance with Embodiment 6 is most desirable for the higher trajectory.

Results of Test 3 (referring to Table 3)

(a) In Embodiments 9–13, when compared with Comparative Example 7, 6–11 m increase of carry and 3–7 m increase of total distance were achieved, under the condition that the head velocity was 49 m/sec, the launch angle was 9.3° and the spin was 3000 rpm.

(b) In Embodiments 9–13, when compared with Comparative Example 7, 6–9 m increase of carry and 4–9 m increase of total distance were achieved, under the condition that the head velocity was 45 m/sec, the launch angle was 10.6°, and the spin was 3300 rpm.

(c) In Embodiments 9–13, when compared with Comparative Example 7, 5–9 m increase of carry and 5–8 m increase of total distance were achieved, under the condition that the head velocity was 40 m/sec, the launch angle was 12.2° and the spin was 3300 rpm.

(d) Accordingly, in any case where the head velocity was 49 m/sec, 45 m/sec, or 40 m/sec, the flight distance was considerably increased according to Embodiments 9–13.

(e) Particularly, Embodiment 10 displayed the most remarkable increase in the carry.

(f) According to Embodiment 11, the total distance was better for the lower trajectory than in Embodiment 10.

(g) Therefore, the golf ball with 432 dimples in accordance with Embodiment 11 is superior for the lower trajectory, while the golf ball with 372 dimples in accordance with Embodiment 10 is most suitable for the higher trajectory.

Results of Test 4 (referring to Table 4)

(a) In Embodiments 14–17, in comparison with Comparative Examples 8 and 9, 7–12 m increase of carry and 3–10 m increase of total distance were achieved, under the condition that the head velocity was 49 m/sec, the launch angle was 9.3° and the spin was 3000 rpm.

(b) In Embodiments 14–17, in comparison with Comparative Examples 8 and 9, 5–10 m increase of carry and 3–9 m increase of total distance were achieved, under the condition that the head velocity was 45 m/sec, the launch angle was 10.6°, and the spin was 3300 rpm.

(c) In Embodiments 14–17, in comparison with Comparative Examples 8 and 9, 4–10 m increase of carry and 4–9 m increase of total distance were achieved, under the condition that the head velocity was 40 m/sec, the launch angle was 12.4° and the spin was 3200 rpm.

(d) Accordingly, in any case where the head velocity was 49 m/sec, 45 m/sec, or 40 m/sec, Embodiments 9–13 showed remarkable increase in the flight distance.

(e) Particularly, the most remarkable effect in the increase of carry was found out in Embodiment 16.

(f) In addition, Embodiment 17 was superior to Embodiment 16 in the total distance with the lower trajectory.

(g) Therefore, the golf ball with 492 dimples in accordance with Embodiment 17 is suitable for the lower trajectory, while the golf ball with 432 dimples in accordance with Embodiment 16 is favorable for the higher trajectory.

As is clear from the above Tests 1–4, if the golf ball is impressed with four kinds of dimples in the form of 20-12 hedron, with an appropriate diameter ratio of the dimples, such flight characteristics as have never been achieved by the prior art golf ball can be realized.

Moreover, it was made clear that the optimum total number N of the dimples changes in accordance with the change in the structure or the size of the golf ball.

Meanwhile, recent needs from golf players extend not only to the wonderful flight distance, but also to the configuration of the trajectory. Some players prefer lower trajectory, while others are good at carries with high trajectory.

In view of the above test results, examples of dimples will be presented for the optimum total distance with the lower trajectory:

(1) Small-size, two-piece ball . . . 372 dimples (FIG. 2),
(2) Large-size, two-piece ball . . . 432 dimples (FIG. 3),
(3) Small-size, thread-wound ball . . . 432 dimples (FIG. 3), and
(4) Large-size, thread-wound ball . . . 492 dimples (FIG. 4).

It is most desirable to change the number of dimples of a golf ball corresponding to the structure and the size of the golf ball.

Further, the following examples of dimples can be presented for the optimum carry with the higher trajectory:

(5) Small-size, two-piece ball . . . 312 dimples (FIG. 1),
(6) Large-size, two-piece ball . . . 372 dimples (FIG. 2),
(7) Small-size, thread-wound ball . . . 372 dimples (FIG. 2), and
(8) Large-size, thread-wound ball . . . 432 dimples (FIG. 3).

The above-presented examples (5)–(8) are most suitable. It is desirable that the number of the dimples of a golf ball be changed in accordance with the change of the golf ball.

This is because the more the total number of the dimples of a golf ball increases, the lower the trajectory becomes, and therefore, the two-piece ball, in comparison with the thread-wound ball, which is difficult to be spinned and the trajectory of which is apt to be lowered is better when the number of the dimples thereon is smaller. Likewise, the small-size ball, in comparison with the large-size ball, which has a smaller diameter and is less affected by the air force so that the trajectory becomes lower than the large-size ball, is better when the number of the dimples is smaller.

In any case, when different kinds of dimples are impressed in combination on a golf ball, the golf ball travels growing straight and resistive against the wind, without hopping which would take place when a golf ball with one kind of dimples is tried to increased the carry. This is the result of balance in the dimension of the dimples which brings about the stabilization of the separation points of the ball during the flight.

In particular, according to the present invention, the dimples are generally uniformly or completely uniformly arranged in the five-cornered divisions 10 in the form of 20-12 hedron, and at the same time, the three-cornered divisions 11 are also arranged with dimples generally uniformly or completely uniformly. Moreover, since the diameter ratio of the largest dimples 1 with respect to the smallest dimples 4 is set within the range of 1.25–1.50, such fine dimple effect as stated above can be obtained.

Although four kinds of dimples 1, 2, 3 and 4 are used in the foregoing embodiments, similar effects can be obtained also when three kinds or two kinds of dimples of different size are used. According to the present invention, it may be preferable in some cases that two kinds of or three kinds of dimples are used.

In the case of four kinds of dimples, if the sum of the number of the largest dimples 1 with the number of the large dimples 2 is made 55–75% of the total number N, the dimple effect obtained through mixing of the dimples 1, 2, 3 and 4 is further promoted, thereby achieving favorable flight characteristics.

As is clear from Tables 1–4, in the case where four kinds of dimples are used in combination therebetween, total dimples volume is desirable to be set in the range of 250–400 $mm^3$. If the total dimples value is out of this range, the dimple effect in improvement of the flight characteristics is undesirably deteriorated.

Accordingly, in the golf ball of the present invention having the construction as described above, since there are arranged two to four kinds of different dimples "regulations with disorderly" on the spherical surface 8 of the golf ball, the air flows uniformly at plural cross sections at right angles with respect to the rotational axis of the ball, and the difference in angles of the separation points can be minimized. Simultaneously, even if the golf ball rotates with centering any rotating axis, the flow of the air on the spherical surface of the ball is never changed, thereby effecting minor directionality in the rotating direction of the ball. Moreover, the flow of the air on the spherical surface 8 of the golf ball is further disturbed because of the two to four kinds of the dimples on the ball, thus realizing stabilization of the separation points. As a result, the resistance against the air is reduced, achieving superior flight characteristics, with the increase of the carry and the total distance. Further, no "hop", which is caused when a prior art golf ball having only one kind of dimples impressed thereon is used for increasing the carry, is given rise to according to the present invention, thereby accomplishing a growing, straight flight of the ball.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A golf ball of improved aerodynamic characteristics having a spherical surface impressed with dimples in the form of a 20-12 hedron, said spherical surface being divided into five-cornered divisions and three-cornered divisions by imaginary circular arcs which are reflectances of edges of the 20-12 hedron on the spherical surface, all twelve of said five-cornered divisions being generally uniformly or completely uniformly provided with said dimples therein, and all twenty of said three-cornered divisions being generally uniformly or completely uniformly provided with said dimples therein, wherein said dimples comprise four sizes having different diameters from each other, with the ratio of the diameter of the largest dimples with respect to the smallest dimples being set to be 1.25–1.50.

2. A golf ball as claimed in claim 1, wherein each of the smallest dimples is placed adjacent to more than one of the largest dimples.

3. A golf ball as claimed in claim 2, wherein the total dimples volume $V_T$ of golf ball is set to be 250–400 mm$^3$, $V_T$ being defined as follows:

$$V_T = V_1 + V_2 + V_3 + V_4, \text{ wherein}$$

$$V_1 = \frac{0.001}{12} N_1\pi \left\{ \sum_{k=1}^{n-1} (E1_{k-1} \cdot E1_k + 2E1_k^2) \right\},$$

$$V_2 = \frac{0.001}{12} N_2\pi \left\{ \sum_{k=1}^{n-1} (E2_{k-1} \cdot E2_k + 2E2_k^2) \right\},$$

$$V_3 = \frac{0.001}{12} N_3\pi \left\{ \sum_{k=1}^{n-1} (E3_{k-1} \cdot E3_k + 2E3_k^2) \right\},$$

$$V_4 = \frac{0.001}{12} N_4\pi \left\{ \sum_{k=1}^{n-1} (E4_{k-1} \cdot E4_k + 2E4_k^2) \right\}, \text{ and}$$

wherein:

$V_T$=total dimples volume,
$V_1$=total dimples volume of largest dimple 1,
$V_2$=total dimples volume of large dimple 2,
$V_3$=total dimples volume of small dimple 3,
$V_4$=total dimples volume of smallest dimple 4,
$N_1$=total number of largest dimple 1,
$N_2$=total number of large dimple
$N_3$=total number of small dimple 3,
$N_4$=total number of smallest dimple 4,
$E1_k$=diameter of largest dimple 1 at point descended in a direction of depth of k microns from the dimple edge (mm),
$E2_k$=diameter of large dimple 2 at point descended in a direction of depth of k microns from the dimple edge (mm),
$E3_k$=diameter of small dimple 3 at point descended in a direction of depth of k microns from the dimple edge (mm),
$E4_k$=diameter of smallest dimple 4 at point descended in a direction of depth of k microns from the dimple edge (mm), and
n=depth of dimple (microns), wherein the flow of the air at every cross section crossing at right angles to the rotational axis of the golf ball is made equal, and at the same time, the angular difference between separation points is minimized.

4. A golf ball as claimed in claim 1, wherein the total dimples volume $V_T$ of golf ball is set to be 250–400 mm$^3$, $V_T$ being defined as follows:

$$V_T = V_1 + V_2 + V_3 + V_4, \text{ wherein}$$

$$V_1 = \frac{0.001}{12} N_1\pi \left\{ \sum_{k=1}^{n-1} (E1_{k-1} \cdot E1_k + 2E1_k^2) \right\}$$

$$V_2 = \frac{0.001}{12} N_2\pi \left\{ \sum_{k=1}^{n-1} (E2_{k-1} \cdot E2_k + 2E2_k^2) \right\}$$

$$V_3 = \frac{0.001}{12} N_3\pi \left\{ \sum_{k=1}^{n-1} (E3_{k-1} \cdot E3_k + 2E3_k^2) \right\}$$

$$V_4 = \frac{0.001}{12} N_4\pi \left\{ \sum_{k=1}^{n-1} (E4_{k-1} \cdot E4_k + 2E4_k^2) \right\}, \text{ and}$$

wherein:

$V_T$=total dimples volume,
$V_1$=total dimples volume of largest dimple 1,
$V_2$=total dimples volume of large dimple 2,
$V_3$=total dimples volume of small dimple 3,
$V_4$=total dimples volume of smallest dimple 4,
$N_1$=total number of largest dimple 1,
$N_2$=total number of large dimple 2,
$N_3$=total number of small dimple 3,
$N_4$=total number of smallest dimple 4,
$E1_k$=diameter of largest dimple 1 at point descended in a direction of depth of k microns from the dimple edge (mm), and
$E2_k$=diameter of large dimple 2 at point descended in a direction of depth of k microns from the dimple edge (mm),
$E3_k$=diameter of small dimple 3 at point descended in a direction of depth of k microns from the dimple edge (mm),
$E4_k$=diameter of smallest dimple 4 at point descended in a direction of depth of k microns from the dimple edge (mm),
n=depth of dimple (microns).

5. A golf ball as claimed in claim 1, wherein the total number of the dimples is set to be approximately 312, with the number of the largest dimples having the diameter 4.2–4.6 mm being approximately 132, the number of the large dimples having the diameter 3.7–4.0 mm being approximately 60, the number of the small dimples having the diameter 3.4–3.7 mm being approximately 60, and the number of the smallest dimples having the diameter 3.1–3.4 mm being approximately 60.

6. A golf ball as claimed in claim 1, wherein the total number of the dimples is set to be approximately 372, with the largest dimples being approximately 120 in number and 4.0–4.4 mm in diameter, the large dimples being approximately 120 in number and 3.4–3.7 mm in diameter, the small dimples beng approximately 60 in number and 3.1–3.4 mm in diameter and the smallest dimples being approximately 72 in number and 2.9–3.2 mm in diameter.

7. A golf ball as claimed in claim 1, wherein the total number of the dimples is set to be approximately 432, with the largest dimples being 3.8–4.2 mm in diameter and approximately 72 in number, the large dimples being 3.4–3.8 mm in diameter and approximately 240 in number, the small dimples being 3.2–3.5 mm in diameter and approximately 60 in number, and the smallest dimples being 2.9–3.2 mm in diameter and approximately 60 in number.

8. A golf ball as claimed in claim 1, wherein the total number of the dimples is set to be approximately 492, with the largest dimples being 3.5–3.9 mm in diameter and approximately 60 in number, the large dimples being 3.2–3.5 mm in diameter and approximately 240 in number, the small dimples being 3.1–3.4 mm in number and approximately 60 in number, and the smallest dimples being 2.7–3.0 mm in diameter and approximately 132 in number.

* * * * *